United States Patent [19]

Helfenstein

[11] Patent Number: 4,926,905

[45] Date of Patent: May 22, 1990

[54] MANUALLY OPERATED AIR VALVE AND ACTUATOR IN COMBINATION CONTROL A HYDRAULIC SPOOL VALVE FOR MANEUVERING HEAVY EQUIPMENT

[75] Inventor: Jim Helfenstein, Portland, Oreg.

[73] Assignee: Williams Controls, Inc., Portland, Oreg.

[21] Appl. No.: 421,964

[22] Filed: Sep. 29, 1989

[51] Int. Cl.[5] ..... F15B 13/042

[52] U.S. Cl. ..... 137/625.6; 137/636.1

[58] Field of Search ..... 137/625.6, 636.1

[56] References Cited

U.S. PATENT DOCUMENTS 3,766,944 10/1973 Distler ..... 137/625.6

*Primary Examiner*—Gerald A. Michalsky

*Attorney, Agent, or Firm*—Robert L. Harrington

[57] ABSTRACT

A proportional remote control having an air regulating controller and an air operated actuator that have matched components to provide a true linear control of the displacement of a valve spool in proportion to lever displacement on the controller. Minimal displacement of the hand lever applies an initial stepped output pressure to the actuator which moves the spool just short of fluid flow. The controller regulates the air pressure applied to the actuator from the initial stepped pressure to its maximum output in proportion to the displacement of its control lever.

4 Claims, 3 Drawing Sheets

MANUALLY OPERATED AIR VALVE AND ACTUATOR IN COMBINATION CONTROL A HYDRAULIC SPOOL VALVE FOR MANEUVERING HEAVY EQUIPMENT

FIELD OF THE INVENTION

A combination air controller valve and an actuator cylinder controlling displacement of a hydraulic valve spool, the combination having improved proportional control through match up of the control springs in the respective controller and actuator.

BACKGROUND OF THE INVENTION

Operator control over heavy equipment such as cranes used in the construction of high rise buildings, presents many problems. The simple movement of a lever by an operator is required to maneuver many tons of equipment delicately to a precise location. The movement of the equipment is accomplished through flow of high pressure hydraulic fluids through hydraulic lines that force movement of hydraulic motors that in turn force rotation at various pivotal joints provided in the equipment.

It is not always feasible to provide direct manual control over the hydraulic valve and a form of pilot control over the hydraulic valve remote from the hydraulic valve is common. The particular type of pilot control contemplated herein is an air control valve (the controller valve) regulating the air pressure applied to a double acting, self centering cylinder (the actuator).

Typical for both the controller and the actuator is the use of control springs. The control spring in the controller valve establishes the PSI in the conduit and responds to the lever setting. The control spring in the actuator establishes the degree of movement of the spool in response to air pressure in the connecting conduit and thereby the extent to which the hydraulic valve is opened. Thus, an operator starts out with the lever of the air control valve in the closed position and accordingly the hydraulic valve is also in the closed position. Movement of the lever effects depression of the controller's control spring which determines the air pressure in the conduit. The control spring in the actuator is depressed by the conduit air pressure and that depression determines the extent of opening of the hydraulic valve.

The problem with the coupled controller valve and actuator cylinder is the development of operator feel and the match up between the two units. It is desirable for the operator to be able to vary the lever position of the controller between fully closed to fully opened positions and get a similarly varied responsive movement for the hydraulic motors that are operating the equipment. If the equipment needs to be adjusted slightly, a slight movement of the lever should produce slow deliberate movement of the hydraulic motor. Similarly, a full movement of the lever should produce maximum rate of movement of the hydraulic motors with in between positioning of the lever accomplishing a proportional rate of movement of the hydraulic motor.

It is known that all controllers (pressure regulating valves) operate near a threshold of instability. The instability is normally deadened due to a significant hysteresis (lagging response) which is inherent in most controllers. To enhance the performance of a controller, the hysteresis must be reduced to a minimum. In doing so the threshold of instability may not be adequately dampened. When the threshold is crossed, a loud annoying harmonic is initiated. The harmonic is usually initiated by a rapid lever movement to a mid-range setting. Once initiated, the harmonic is self propagating and will not end until the lever is returned to the center position. In some controllers of the past the harmonic would not cease until the supply air was terminated. In addition to the displeasure of the operator with the noise, the controlled equipment is not responsive and damage to the regulating section of the controller is likely to occur. When the harmonic is initiated, the output pressure is in effect dithered and the average pressure remains low. The combined mass of the actuator and the spool coupled with the biasing force of the control spring provides a resistance too large even for the momentary spiked pressure set up by the harmonic. Therefore the controlled equipment does not respond to lever displacement on the controller as would be expected by the operator. Obviously, such harmonics are to be avoided.

A second problem is that the hydraulic valve and actuating cylinder is typically developed by the hydraulic valve manufacturer and the air control valve by the control manufacturer. In one case the air valve may be set to be wide open and hydraulic valve only partially open thereby preventing maximum utilization of the hydraulic motor. In the alternate case, the hydraulic valve will be wide open and the air control valve only partially open thereby reducing the control capability for the operator, i.e. the effective stroke of the lever is shortened and operator "feel" is made more difficult.

BRIEF DESCRIPTION OF THE INVENTION

The present invention focuses on two features. A poppet in the air control valve (controller) has a two-tier diameter configuration that moves through an orifice that separates the air source from the conduit leading to the actuating cylinder (actuator). When fully seated, the poppet prevents the air from passing through the orifice. During movement away from the seated position, the poppet has an initial large diameter positioned in the orifice and air passage is significantly restricted. Air pressure on the outlet side of the orifice builds up more gradually and the undesired harmonic is avoided. Further movement of the poppet away from the seated position places the second diameter on the poppet in the orifice. The second diameter is less than the initial diameter permitting greater air flow and allows the air pressure in a second stage of operation to build rapidly as the poppet is fully unseated from the orifice.

The second feature of the invention resides in the matching of the control springs of the controller and actuator. The controller's lever movement and the reaction of the control spring determines the PSI generated in the conduit leading to the actuator. The control spring of the actuator responds to the PSI from the conduit to open the hydraulic valve. The greater the PSI from the conduit, the more the spring is compressed and the more the hydraulic valve is opened.

It is desirable that the controller's lever movement from closed to fully opened positions be proportionately matched to correspond to the fully closed to the fully opened positions of the hydraulic valve. In the present invention, this matching is accomplished by the appropriate selection of the control springs of the controller and the actuator.

The specific structure is explained in more detail in the following description having reference to the accompanying drawings.

DESCRIPTION OF THE PREFERRED EMBODIMENT

Figure 1:
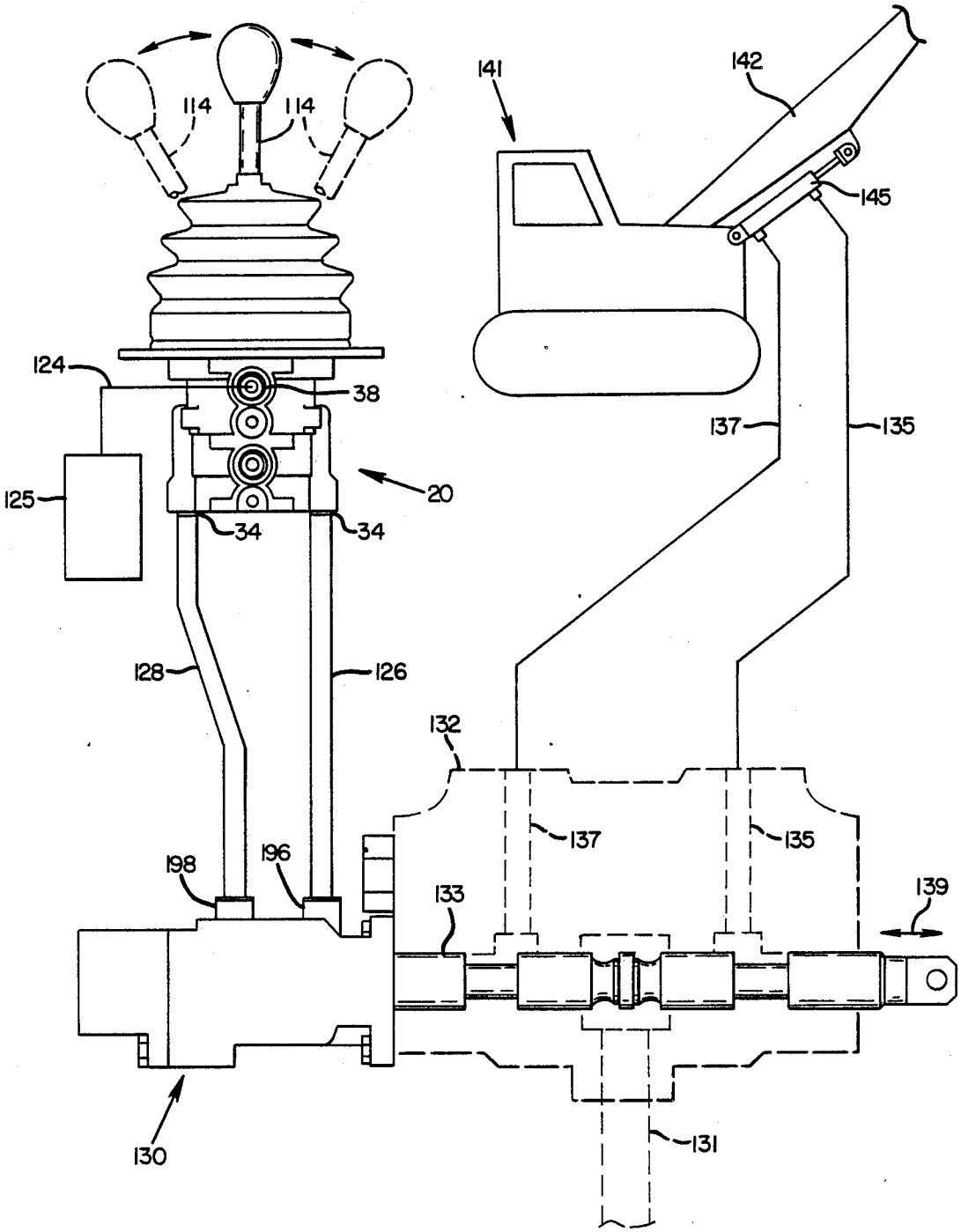
FIG. 1 illustrates a controller valve connected to an actuator.

Reference is first made to FIG. 1 for a general description of one application of the invention. A hydraulic valve 132 is schematically illustrated and includes a high pressure hydraulic inlet conduit 131 that is alternately connected to one of the outlet conduits 135, 137. A valve stem or spool 133 is moveable as indicated by arrow 139 to redirect hydraulic fluid flow from inlet conduit 131 to one or the other of outlet conduit 135, 137. Reference 141 indicates a machine having a boom 142 that is maneuvered by a hydraulic motor 145, which in turn is actuated by conduit lines 135, 137. The boom 142 is raised and lowered by sliding adjustment of the spool 133. Adjustment of the spool 133 is in turn determined by the air controlled actuator 130 which is responsive to the controller valve 20. The operation will be explained in more detail in a later section following the detail description of the air controller valve and actuator.

CONTROLLER VALVE

Figure 2:
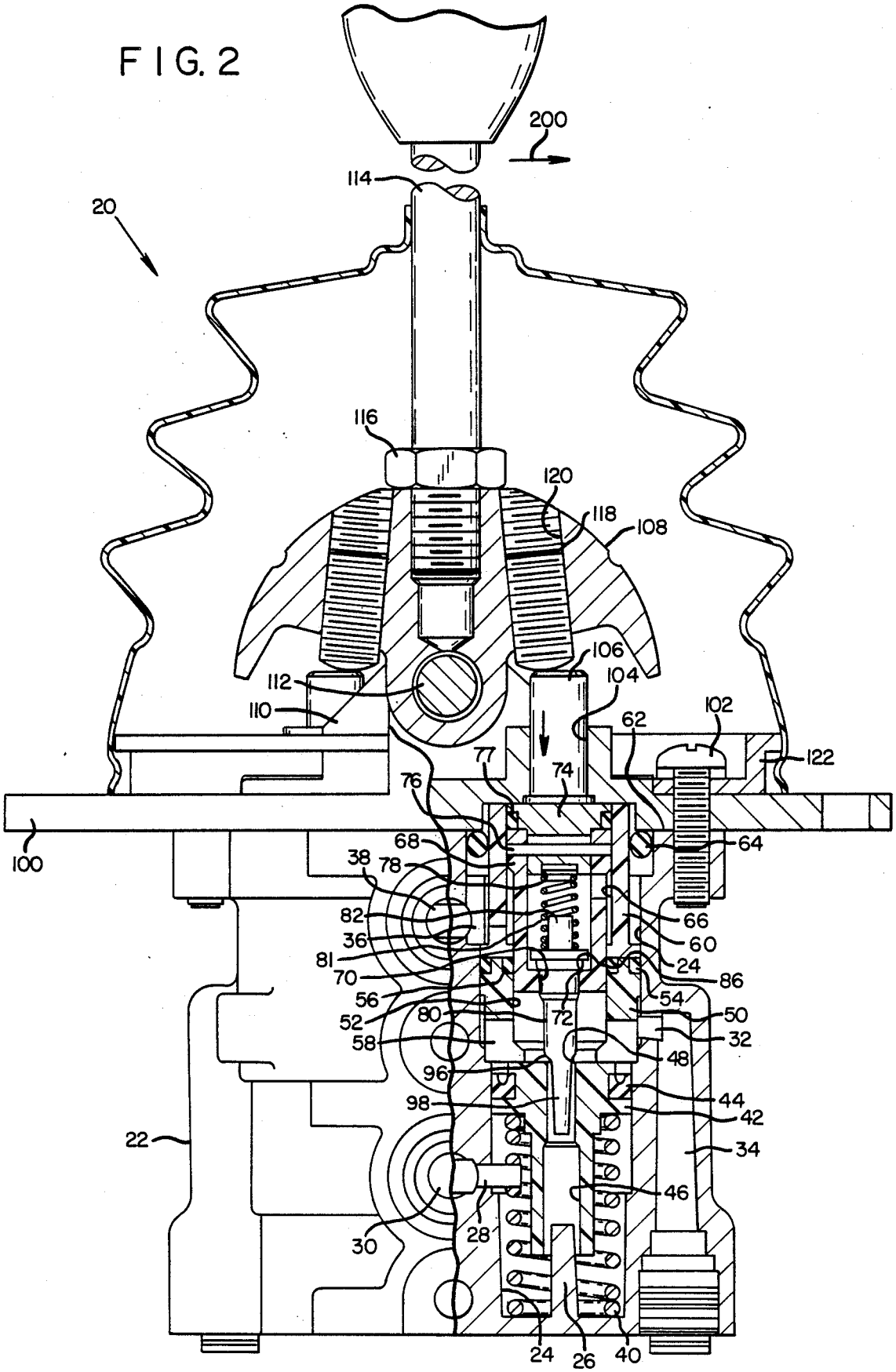
FIG. 2 is a view of the controller valve with a sectional view of one of the pressure regulating sections.

A controller 20 having two independent pressure regulating sections is illustrated in FIG. 2, with one of the pressure regulating sections shown in cross section. The controller 20 has a body 22 which houses the two pressure regulating sections. The two sections are identical in construction and therefore only one section will be detailed.

A cavity in the body 22 in the form of a stepped blind bore 24 houses the components of the regulating section. A pedestal 26 is formed at the base of the bore. Passageways are provided in the side wall of the stepped bore 24. Passageway 28 connects the bore to the exhaust port 30. Passageway 32 connects the bore to the outlet port 34. Passageway 36 connects the bore to the supply port 38.

The components of the regulating section are installed in the bore 24 as shown in FIG. 2. A helical compression spring 40 fits in the bottom of the bore 24 with one end of the spring in contact with the bottom of the bore. A piston 42 is installed in the bore above the spring with the underside of the piston in contact with the spring 40. The spring 40 thus urges the piston 42 upward. A piston cup 44 provides a seal between the piston and the bore 24. The piston 42 has through bore 46 with an exhaust seat 48 formed at the top edge of the bore. The exhaust seat formed on the top edge of the bore defines an exhaust orifice.

Installed above the piston 42 is a barrier sleeve 50. The base of the barrier sleeve 50 is abutted against a shoulder in the stepped bore 24 and and the bottom edge of the barrier sleeve 50 limits the upward travel of the piston 42. The barrier sleeve 50 has an internal bore 52 that will accept the cartridge body 68. Provision is made at the top of the barrier sleeve 50 for o-ring seals. O-ring 54 seals against the wall of the bore 24 and o-ring 56 provides a seal between the internal bore 52 and the cartridge body. The lower portion of the barrier sleeve 50 has slots 58 that permits passage of air from the internal bore 52 to the outlet port 34 via passageway 32.

A sleeve 60 having an internal bore 66 fits in the upper portion of the bore 24 and is abutted against the barrier sleeve 50 and also is in compressive contact with o-rings 54 and 56. The sleeve 60 extends above the top surface 62 of the body 22. An o-ring 64 provides a seal between the sleeve 60 and the bore 24. The lower portion of the sleeve 60 is slotted to permit passage of air from the supply port 38 via passageway 36 to the internal bore 66 of the sleeve. Note the cross section of the wall of the sleeve 60. It is in the shape of an inverted tee and this shape provides a free space between the bore 24 and the outside diameter of the sleeve. It also provides a space between the internal diameter of the sleeve and the external diameter of the lower portion of the cartridge body 68.

A cartridge body 68 fits within the bore 52 of the barrier sleeve 50 and the bore 66 of the sleeve 60. The body 68 has an internal cavity, is basically cylindrical in shape, is open ended at the top and has a lower end with a through bore 70 as shown in FIG. 2. Slots in the wall of the cylinder are provided for the passage of air from the internal bore 66 of the sleeve 60 to the cavity of the body 68. On the top edge of the bore 70 (as viewed in FIG. 2) an inlet seat 72 is formed. The inlet seat formed on the top edge of the bore defines an inlet orifice. A poppet 80 fits within the internal cavity of the cartridge body 68. The poppet 80 is yieldably urged against the inlet seat 72 by poppet spring 81 that is in compression between the top of the poppet and the underside of the cartridge cap 74 which is fixedly attached to the top of the cartridge body 68 by a pin 76. The poppet spring 81 is retained in position by a recess 78 in the cartridge cap 74 and by a cylindrical projection 82 on the top of the poppet 80. An o-ring 77 seals the cartridge cap 74 and the cartridge body 68 with respect to the bore 66 in the sleeve 60. The poppet 80 extends through the bore 70 of the cartridge body 68 with the seating portion 86 of the poppet 80 in engagement with the inlet seat 72. The lower seating portion 96 of the poppet 80 will engage the exhaust seat 48 of the piston 42. The nose 98 of the poppet 80 enters the bore 46 of the piston 42.

A plate 100 is secured to the body 22 by fasteners 102. The plate 100 has a bore 104 that is in alignment with the bore 24 of the body 22. A stem 106 fits in the bore 104 and contacts the cartridge cap 74. A rocker arm 108 is pivotally mounted on a support structure 110 by a shaft 112. A handle 114 is threadably mounted to the rocker arm 108 and locked in position by nut 116. A tappet 118 (or ram) is adjustably mounted in a bore 120. The tappet engages the top of the stem 106. A protective boot is secured to the top plate 100 by a bracket 122.

Figure 4:
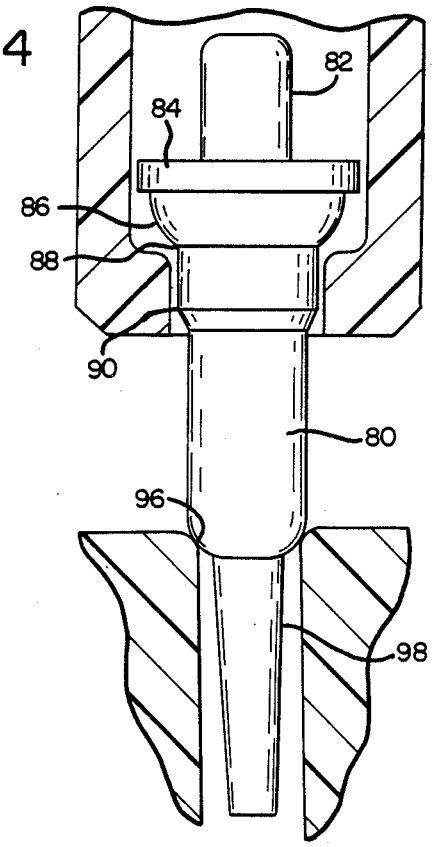
FIG. 4 is a view of the poppet of the controller valve.

The poppet 80 as illustrated in FIG. 4 has an important function in addition to controlling the inlet and exhaust of air. The poppet 80 has a restricted or a choking section just below the seating section 86. The choking section extends from the lower end of the seating section 86 indicated by numeral 88 and extends downward to the diameter change indicated by 90. It is believed that unrestricting the first flow of pressurized air through the inlet seat 72 accelerates the piston 42 downward and the inertia developed moves the piston down beyond the point where the spring 40 would normally restrain it. The over-travel by the piston not only closes the inlet but also opens the exhaust. Some of the pressurized air escapes through the exhaust resulting in reduction of pressure over the piston. The reduced pressure permits the spring to accelerate the piston upward with an over-travel occurring on the up-stroke. The piston contacting and moving the poppet will "pop" the inlet open again and the cycle is repeated. The cycle is self propagating and will not cease until the lever of the controller is returned to the neutral (center) position. This action is referred to as the undesired harmonics previously discussed. The restricted or choking section provided controls the rate of initial air flow and prevents piston over-travel.

In this embodiment, the choking section of the poppet is provided by a diameter that is close dimensionally to the diameter of the bore 70 (inlet orifice). Below the choking section, the poppet 80 has a full flow section that has a diameter less than the choking section which permits a larger volume of air flow through the inlet orifice as the poppet moves further away from the inlet seat 72.

The choking section of the poppet can have other configurations. The sections below the seating portion could be a composite section that decreases in diameter (either linearly or non-linearly) rather than having stepped diameters.

Other variations that provide a choking or restriction of initial air flow are contemplated.

The important consideration is the restriction of first flow of pressurized air through the inlet orifice.

ACTUATOR

Figure 3:
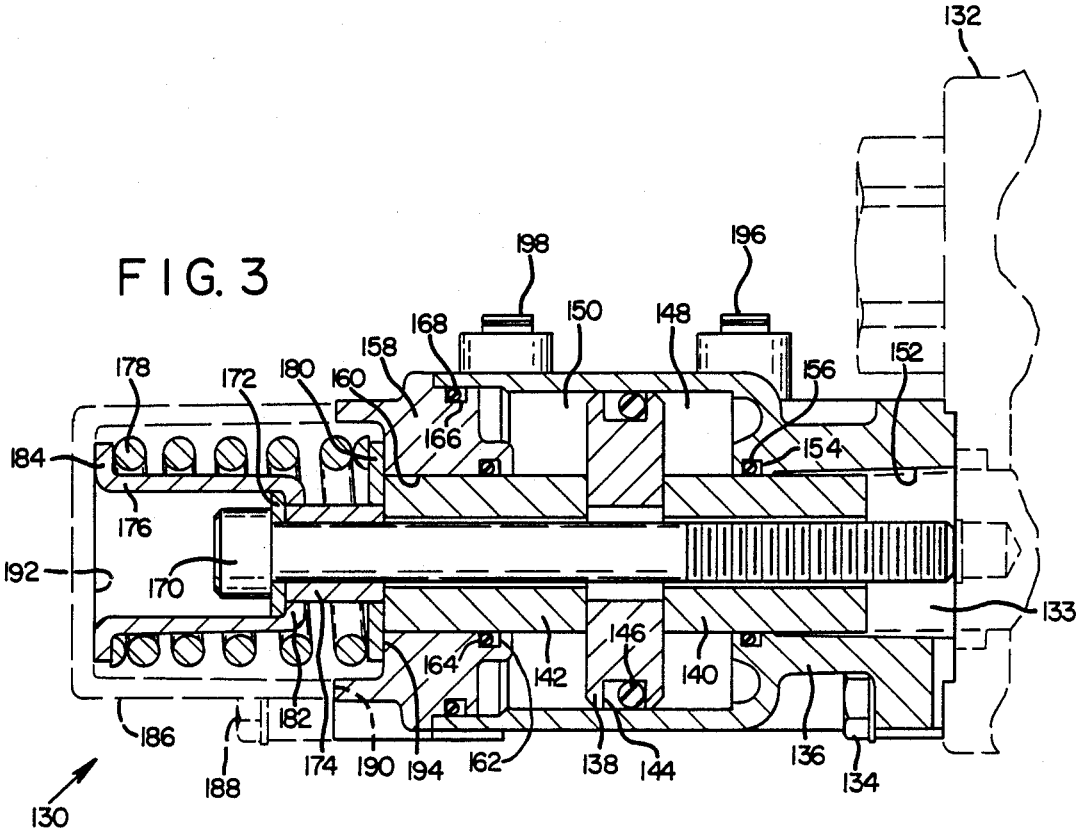
FIG. 3 is a sectional view of the actuator attached to a hydraulic valve body.

A sectional view of an actuator 130 attached to a spool valve 132 by threaded fasteners 134 is illustrated in FIG. 3. The actuator 130 is a double acting, self centering cylinder. The actuator body 136 is bored to accept the piston 138 and a bushing 140 of the piston assembly. The piston assembly includes a piston 138 with bushings 140 and 142 installed on each side of the piston. The piston 138 and the bushings 140 and 142 have a center through bore. The piston 138 has an o-ring groove 144 formed on its external diameter with an o-ring 146 fitting within the o-ring groove 144 to seal the chamber 148 formed on one side of the piston from the chamber 150 formed on the other side of the piston 138. The bushing 140 fits in a bore 152 of the body 136 of the actuator 130. The bore 152 has an o-ring groove 154 that accepts an o-ring 156 to seal the chamber 148. The bore 152 has a slight taper commencing just beyond the o-ring groove 154 and extending to the end of the body 136. The taper provides a relief for the end of the spool 133 of the valve 132 and also facilitates in compensating for any minor mis-alignment that may occur between the actuator body 136 and the spool valve 132. The bushing 140 abuts against one side of the piston 138. The other bushing 142 is installed on the opposite side of the piston 138 with the bushing 142 fitting in a bore 160 of the end cap 158. The bore 160 in the end cap 158 has a groove 162 to accept an o-ring 164. The external diameter of the end cap also has an o-ring groove 166 to accept an o-ring 168.

A threaded socket head cap screw 170 having a washer 172, a sleeve 174, a spring collar 176, a compression spring 178 and a washer 180 installed at the cap end is inserted through the center through bores of the bushing 140, piston 138 and bushing 142. The threaded end of the cap screw 170 is threadably engaged with the spool 133 of the spool valve 132. The cap screw 170 engaged with the spool 133 thus secures the cap screw 170, washer 172, sleeve 174, bushing 142, piston 138, and bushing 140 in fixed positions relative to each other. The spring collar 176 and the washer 180 fit loosely over the sleeve. An internal lip 182 of the collar 176 engages the washer 172. The compression spring 178 encircles the spring collar 176 and extends beyond the collar to engage the washer 180. One end of the spring is in contact with an external lip 184 of the collar 176. A spring cover 186 is secured to the body of the actuator by threaded fasteners 188. The end 190 of the cover holds the end cap 158 to the body 136. The internal face 192 of the cover 186 contacts the spring collar 176 and the spring 178 being in contact with the collar 176 and the washer 180 places the washer 180 in contact with face 194 of the end cap 158. This is the normal position of the assembly when the pressure in the chambers 148 and 150 are equal. The control spring 178 biases the piston 138 toward the center position.

Ports 196 and 198 are provided to supply air to the chambers. Port 196 is connected to chamber 148 and port 198 is connected to chamber 150.

OPERATION

Refer now, also to FIG. 1 which shows a controller 20 connected to an actuator 130 by air lines 126 and 128. The air line 126 connects one outlet port 34 of the controller to the port 196 of the actuator 130 and the air line 128 connects the other outlet port 34 to the port 198. The actuator 130 is installed on a valve 132.

A supply source 125 supplies compressed air to the supply port 38 of the controller 20 by the air line 124 and the air enters through the passageway 36 to fill the void around the sleeve 60 and the internal cavity of the cartridge body 68. The poppet 80 being seated in the inlet seat 72 prohibits air flow from the cavity of the cartridge body 68.

The air supply pressure provides the force which returns the lever 114 to the neutral or off position. The force is a function of the differential area defined by the outside diameter of the o-ring 77 minus the inside diameter of the o-ring 56.

An initial incremental pivotal movement (less than three degrees) of the hand lever 114 in the direction indicated by arrow 200 (FIG. 2) will pivot the rocker arm 108 causing the tappet 118 (ram) to move the stem 106, cartridge cap 74, cartridge body 68 and the poppet 80 in a downward direction. The initial movement of the lever brings the seating portion 96 of the poppet 80 into contact with the exhaust seat 48 of the piston 42. At this point the seating portion 86 of the poppet 80 is still seated in the inlet seat 72 of the cartridge body 68. The poppet seated in the exhaust seat 48 of the piston 42 is restricted in further downward motion by the spring 40 biasing the piston 42 in an upward direction. Pivoting the lever to three degrees moves the cartridge body 68 further in the downward direction, causing the poppet 80 to separate from the inlet seat 72 and the air enters the air chamber above the piston 42 and out the outlet port 34. This is the position that permits initial air flow through the inlet seat.

In one example of the preferred embodiment, a pressure of 20 psig must be developed above the piston 42, i.e. in the air chamber, before any downward motion of the piston will occur. This is due to the specific preload of the spring 40 biasing the piston 42 upward. Holding the operating lever 114 rigidly in the position that permits the initial air flow through the inlet 72 seat will cause the pressure above the piston 42 to elevate to 20 psig which will move the piston 42 downward and the poppet 80 will again close the inlet seat 72.

The initial stepped pressure of 20 psig will overcome the centering force of the centering (control) spring 178 of the actuator 130 and the dynamic hydraulic forces acting on the spool 133 of the valve 132. The initial stepped pressure of 20 psig will move the piston 138 of the actuator 130 and thus the spool 133 of the valve 132 just short of hydraulic first flow.

Further movement of the hand lever 114 and the resulting movement of the cartridge body 68 causes the poppet 80 to leave the inlet seat 72 permitting additional air flow to the volume above the piston 42 and the outlet port 34. An increase of pressure is now required to move the piston 42 downward to close the inlet. If the lever 114 is now held in a fixed position the increased pressure developed will move the piston 42 downward and the poppet 80 will again close the inlet. This establishes a different, higher pressure in the volume above the piston 42 and in the outlet port 34. The higher pressure will displace the piston 138 in the actuator 130 which moves the spool 133 of the valve 132 further.

As the outlet pressure above the piston 42 increases, the lever return force also increases. The added force is the result of the outlet pressure acting upwardly on the cartridge body 68 and poppet 80. The effective area being the internal diameter of o-ring 56. The added return force provides an operator with an operational "feel".

As the lever 114 is incrementally returned to its center position, the output air pressure is proportionately reduced. This occurs when the cartridge body 68 lifts the poppet 80 away from the exhaust seat 48. Air is exhausted out the exhaust port 30 thereby reducing the pressure above the piston 42. The spring 40 then moves the piston 42 upward until the poppet 80 again is seated in the exhaust seat 48. This re-establishes a new pressure setting. The reduced air pressure above the piston and therefore in the outlet port reduces the pressure applied to the piston 138 of the actuator. The reduced applied pressure causes the centering spring 178 to move the piston 138 and therefore the spool 133.

The controller 20 varies the output pressure from the initial stepped output pressure to its maximum limit in proportion to the displacement of the hand lever 114. Conversely, the pressure is reduced from its maximum limit to the initial stepped pressure in proportion to the reverse displacement of the hand lever 114.

The spring forces of the spring 40 of the controller 20 and the spring 178 of the actuator 130 are selected so that the spool 133 will reach full travel when the lever 114 of the controller 20 is moved to its travel limit. This eliminates any "dead-band" motion of the hand lever 114 with the added benefit of a true proportional remote control.

In the embodiment described, the supply pressure is 100 psig. The spring force of the spring 40 is selected to provide a nominal maximum output pressure of 85 psig (±5 psi). The spring 178 is selected so that the spool 133 will reach full travel when the output pressure reaches its maximum (85 psig). The output pressure reaches its maximum when the lever 114 is moved to its travel limit, therefore the spool will reach full travel when the lever reaches full travel.

The lever 114 will pivot thirty degrees from the center position. The initial stepped output pressure requires only a three degree movement of the lever which leaves twenty seven degrees of movement to control the proportional displacement of the valve spool.

In the embodiment detailed, a single lever controlled a single controller having two pressure regulating sections. The controller supplies air pressure to a single actuator which provides controlled movement of a spool in a hydraulic valve. Two controllers may be stacked with a single lever controlling both controllers to provide air pressure to two actuators which will provide movement to spools in two hydraulic valves.

More than one controller may be installed remotely to supply air pressure to a single actuator. This provides the capability of controlling a single hydraulic valve from more than one location.

Variations and modifications will be apparent to those skilled in the art and therefore the scope of the invention is not to be limited to the description set forth but is to be according to the appended claims.

What is claimed is;

1. In combination, an air regulating controller valve having a regulating section, and an air operated actuator controlling a hydraulic valve for manual operator control of heavy equipment comprising;

said regulating section of the controller valve having a movable cartridge with an inlet orifice, a moveable first piston with an exhaust orifice, and a poppet protruding through the inlet orifice and into the exhaust orifice, said inlet orifice and exhaust orifice defining therebetween an air pressure chamber, a first spring means biasing the poppet into a closed position in the inlet orifice, a second spring means biasing the piston toward the poppet, and manual control means for selectively moving the movable cartridge toward the first piston whereby the poppet is urged to a closed position in the exhaust orifice and to an open position in the inlet orifice to thereby permit air from the cartridge to pass through the inlet orifice into the air pressure chamber until the biasing force of the second spring means is overcome by air pressure in the chamber to force retraction of the first piston and thereby allow the first spring means to move the poppet into closed position in the inlet orifice;

an actuator having a movable second piston, a conduit directing air pressure from the air pressure chamber in the regulating section to one side of the movable second piston urging a first directional movement thereof, and a third spring means resisting said first directional movement of the second piston, said moveable second piston having a defined distance of effective movement and said third spring means providing increasing resistance to said first directional movement of the second piston throughout said distance of effective movement;

said moveable first piston having a defined distance of effective movement and said second spring means providing increasing resistance to movement of the first piston throughout said distance of effective movement, said second spring means being matched to said third spring means whereby movement of the first piston along its defined distance of effective movement establishes air pressure in the conduit that generates a proportionate movement of the second piston along its defined distance of effective movement.

2. In a combination as defined in claim 1 a second regulating section of said controller valve having the defined elements of the first regulating section, and a second conduit from the air pressure chamber of the second regulating section directed to the opposite side of the second piston in the actuator, and fourth spring means having a function similar to the third spring means for resisting movement of the second piston in a direction opposite said first directional movement generated by the first regulating section.

3. In a combination as defined in claim 2 which includes said poppets each having first and second positions when unseated from their closed positions in the inlet orifices, each of said poppets having a choking section located in the inlet orifice in the first position and a full flow section located in the inlet orifice in the second position whereby air flow through the inlet orifice is restricted when the poppet is in the first position and is less restricted when the poppet is in the second position.

4. In a combination as defined in claim 3 which includes said manual control means being a pivotal lever including a first ram portion that is pivoted by said lever toward said cartridge of the first regulating section of said controller valve to unseat the poppet thereof, and having a second ram portion that is pivoted in an opposite direction of pivoting of the lever toward said cartridge of the second regulating section of said controller valve to unseat the poppet thereof.

* * * * *